US010276135B1

(12) United States Patent
Purol

(10) Patent No.: US 10,276,135 B1
(45) Date of Patent: Apr. 30, 2019

(54) ACOUSTIC RESONATOR COUPLING

(71) Applicant: David Merritt Purol, Romney, WV (US)

(72) Inventor: David Merritt Purol, Romney, WV (US)

( * ) Notice: Subject to any disclaimer, the term of this patent is extended or adjusted under 35 U.S.C. 154(b) by 0 days.

(21) Appl. No.: 16/155,214

(22) Filed: Oct. 9, 2018

(51) Int. Cl.
*G10D 3/02* (2006.01)
*G10D 1/08* (2006.01)

(52) U.S. Cl.
CPC ..... *G10D 3/02* (2013.01); *G10D 1/08* (2013.01)

(58) Field of Classification Search
CPC ..... G10D 3/02; G10D 1/08
See application file for complete search history.

(56) References Cited

U.S. PATENT DOCUMENTS

2008/0053288 A1* 3/2008 Brunkalla ..... G10D 3/02 84/267
2014/0144306 A1* 5/2014 Seal ..... G10D 1/005 84/291

* cited by examiner

*Primary Examiner* — Kimberly R Lockett
(74) *Attorney, Agent, or Firm* — Purol Patents

(57) ABSTRACT

The present invention provides an acoustic resonator coupling for securing a tuning fork within a stringed instrument body. The acoustic resonator coupling incorporates the use of retractable prong members to imbed the coupling to the wood of the instrument body. The prong members penetrate the wood leaving only a very small prick mark that does not mar the material of the instrument body thus retaining the value and aesthetics of the stringed instrument. Provisions are provided on the acoustic resonator coupling permitting for the releasable mounting of the tuning fork.

21 Claims, 3 Drawing Sheets

ACOUSTIC RESONATOR COUPLING

CROSS-REFERENCE TO RELATED APPLICATION

Not Applicable

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of stringed instruments and devices relating thereto having a resonance device for changing the quality of tone of the instrument. When a stringed instrument is played the vibratory movement of the strings set the resonance device in motion producing a purer sound tone and reducing the rapid decay of tone.

2. Description of the Related Art

Conventional stringed instruments when played have a large amount of the vibratory sound being produced absorbed and dissipated by the body of the instrument. This absorption of the vibratory sound creates a muffling characteristic of the instrument's tonality yielding a diminished, dull sound, accompanied by an overall loss of volume. Previous attempts at overcoming this loss of sound have been through the use of resonator guitars which produce sound by conducting string vibrations through the bridge to one or more spun metal cones or resonators instead of to the guitar's sounding board. While a resonator guitar produces a louder volume, it does so by producing a metallic sound that greatly alters the natural sound of the instrument's body. The bulky and heavy material of a resonator guitar makes it an uncomfortable and awkward instrument to play. The construction involved in making a resonator guitar is complex and relies upon several components making its high cost prohibited.

Ideally, a resonator for an instrument should be unobtrusive, lightweight, and versatile, yet would operate reliably and be manufactured at a modest expense. Thus, a need exists for a reliable acoustic resonator coupling to avoid the above-mentioned problems.

BRIEF SUMMARY OF THE INVENTION

In view of the foregoing disadvantages inherent in the known resonator guitar art, the present invention provides for a novel acoustic resonator coupling. The general purpose of the present invention, which will be described subsequently in greater detail is to provide a coupling for an acoustic resonator within a stringed instrument body. Tuning forks are an excellent acoustic resonator and are readily available. The playing of the stringed instrument creates vibrations of sound producing a corresponding or sympathetic vibration to the tuning fork. As a consequence, greater volume, depth, and brilliancy to the sounds produced by the stringed instrument are added.

It is thus an object of the present invention to provide a coupler for securing a tuning fork within a stringed instrument body. The acoustic resonator coupling incorporates the use of retractable prong members to imbed the coupling to the wood of the instrument body. The prong members penetrate the wood leaving only a very small prick mark that does not mar the material of the instrument body thus retaining the value and aesthetics of the instrument. Provisions are provided on the acoustic resonator coupling permitting for the mounting of the tuning fork.

The present invention holds significant improvements and serves as a coupling for an acoustic resonator within an instrument body. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate a preferred embodiment of use for the acoustic resonator coupling of the present invention, constructed and operative according to the teachings of the present invention.

The various embodiments of the present invention will hereinafter be described in conjunction with the appended drawings, wherein like designations denote like elements.

DETAILED DESCRIPTION

Figure 1:
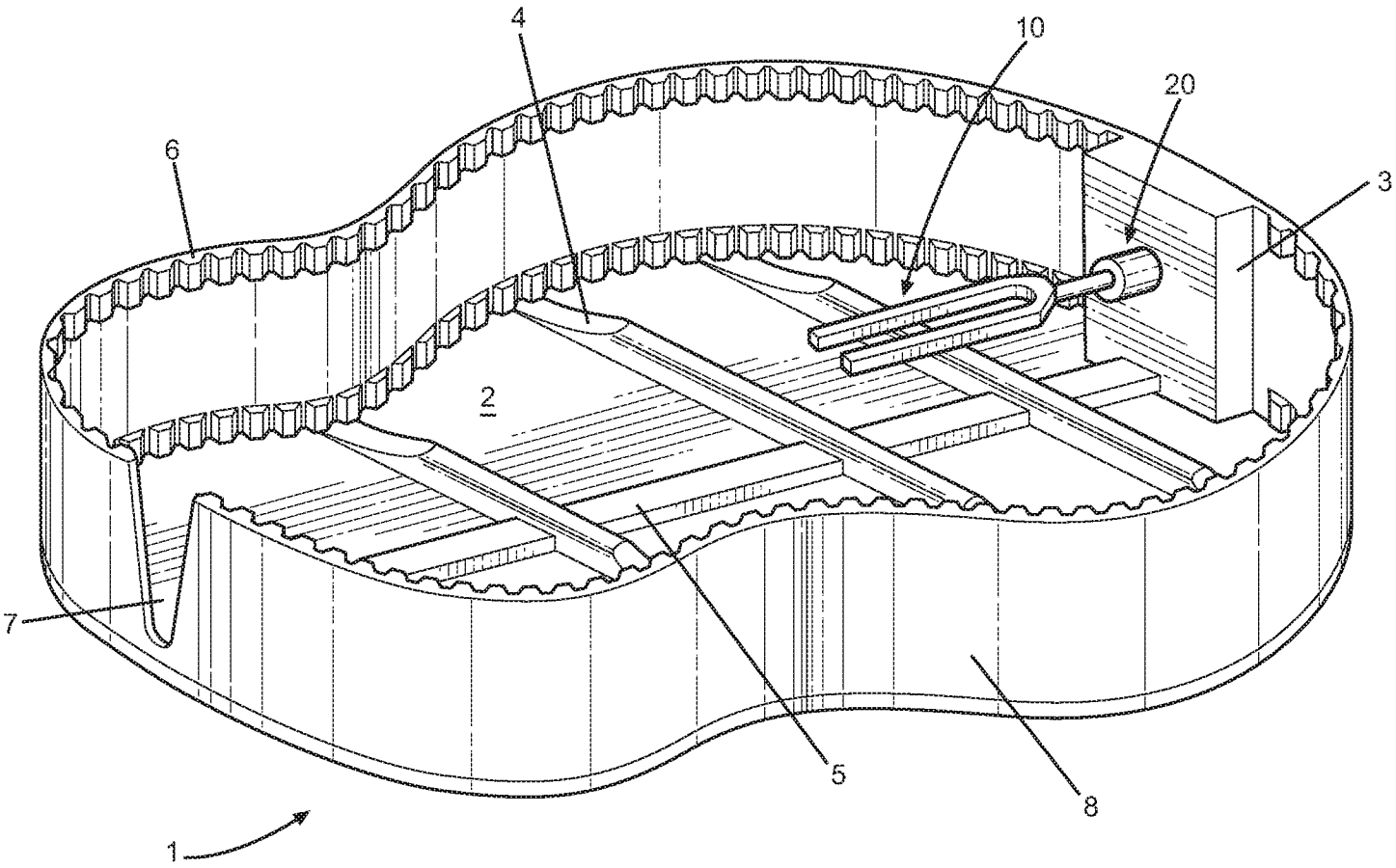
FIG. 1 shows a perspective view illustrating an instrument body having an acoustic resonator mounted thereon by a coupling according to an embodiment of the present invention.

As discussed above, an embodiment of the present invention relates to a coupling for mounting an acoustic resonator to an instrument body. Referring to the drawings by numerals of reference there is shown in FIG. 1 a body 1 of a stringed instrument such as an acoustic guitar. The body 1 is commonly constructed from solid tonewoods that reproduce sound well including one of mahogany, rosewood, spruce, or cedar. It is with these tonewoods that the acoustic resonator coupling of the present invention is suited, as will be further described.

The body 1 is defined by a bottom board or back piece 2 circumscribed by a side wall 8. The upper and lower portions of the side wall 8 are provided with a continuous or serrated lining strip 6 to which the bottom board 2 and the top sound board (not shown) are attached. The side wall 8 has a slot 7 for accommodating the heel of a neck (not shown). The body 1 is strengthened by cross bracing 4 and reinforcements strips 5. The body 1 is provided with a tail block 3 that stabilizes where the sides of the side wall 8 meet at the lower bout. Mounted to the tail block 3 is a coupler 20 of the present invention. Secured to the coupling 20 is an acoustic resonator such as a tuning fork 10.

Figure 2:
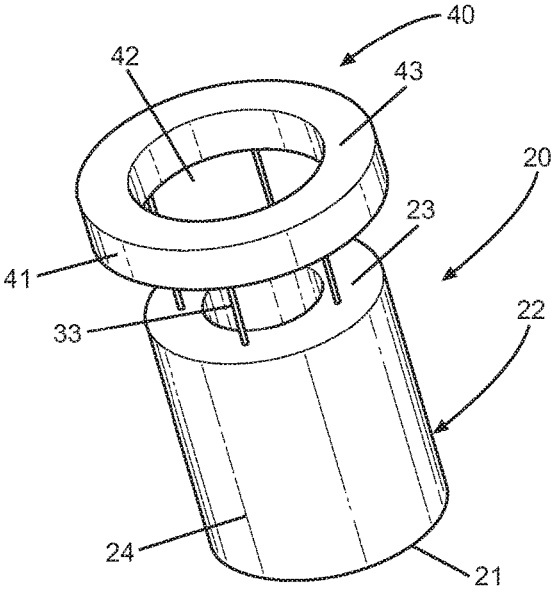
FIG. 2 is a perspective view illustrating an acoustic resonator coupling according to an embodiment of the present invention of FIG. 1.
Figure 3:
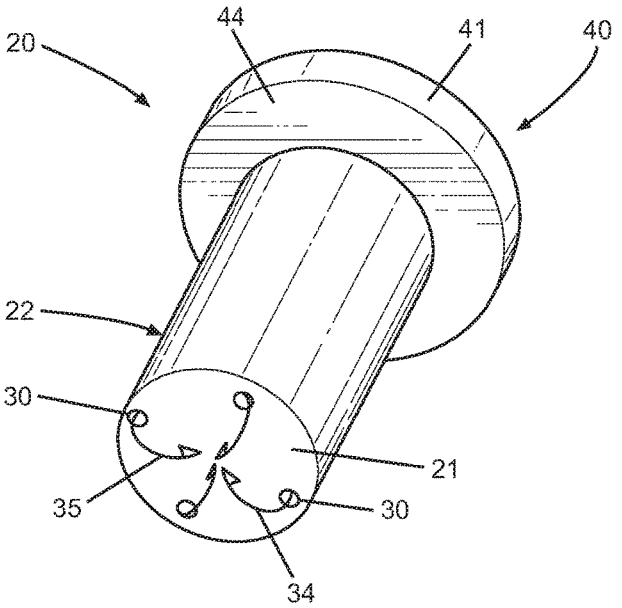
FIG. 3 is a bottom perspective view illustrating an acoustic resonator coupling with the prong members extended according to an embodiment of the present invention of FIG. 1.
Figure 6:
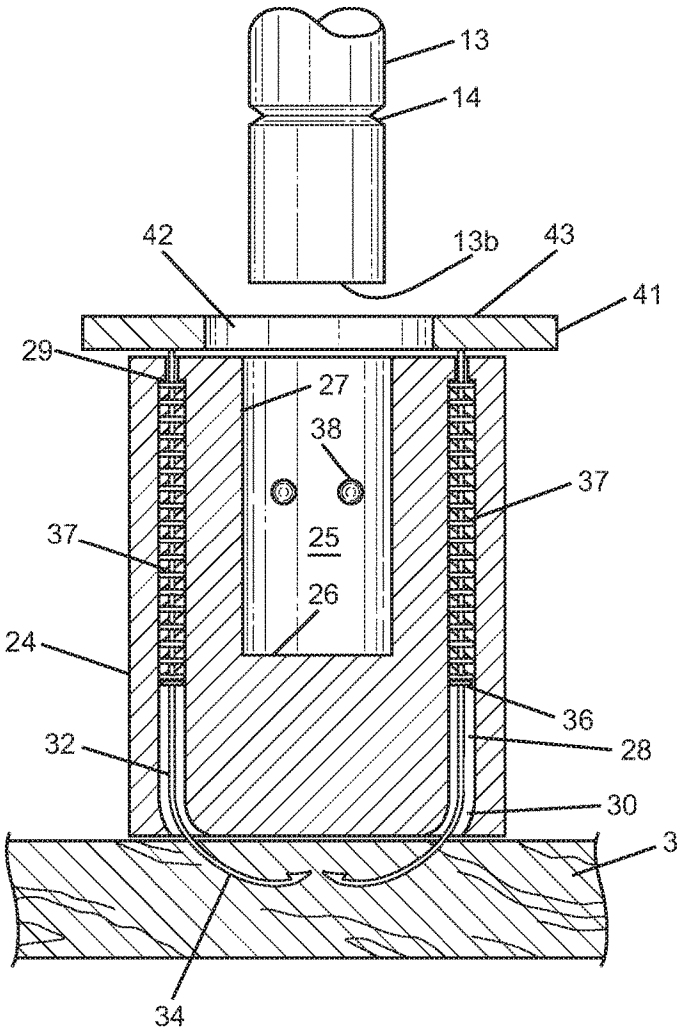
FIG. 6 is a cross sectional view illustrating an acoustic resonator being mounted to a coupling secured to the instrument body according to an embodiment of the present invention of FIG. 1.
Figure 5:
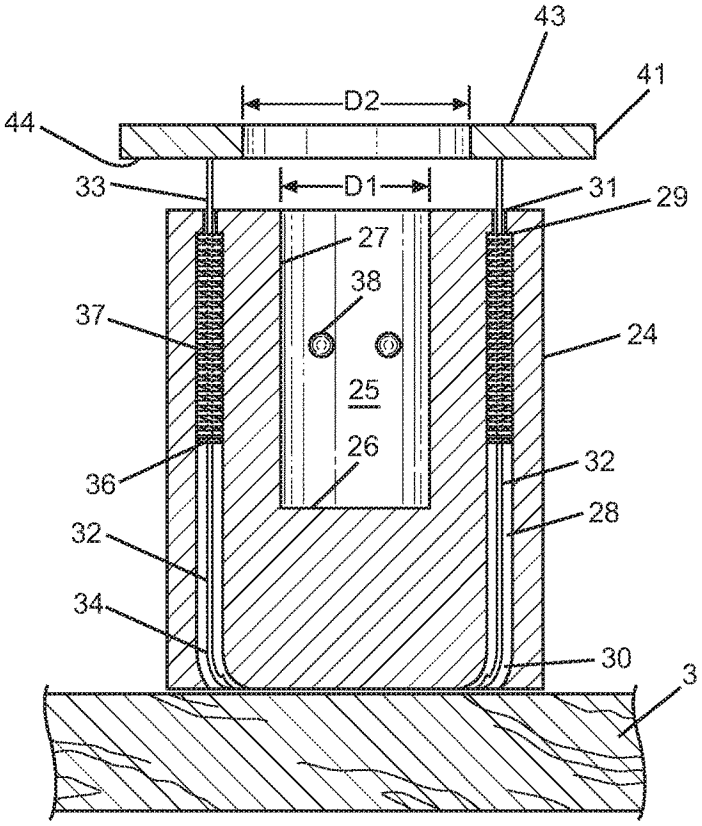
FIG. 5 is a cross sectional view illustrating an acoustic resonator coupling with the prong members retracted prior to mounting according to an embodiment of the present invention of FIG. 1.

Referring now to FIGS. 2, 3 along with FIGS. 5, 6 there is shown the coupler 20 formed as an elongate body 22 of a generally cylindrical shape having an outer surface 24. The elongate body 22 has at an end a first surface 23 and at an opposed end a second surface 21. Centrally disposed on the first surface 23 is a blind bore 25 having a sidewall 27 and terminating at a bore wall 26. The blind bore 25 establishes an opening of a first diameter D1. The elongate body 22 is provided with a spring biased ball plunger 38 in communication with the blind bore 25 as will be further discussed.

The elongate body 22 is provided with one or more channels 28 each of which are identical and of which a description of one channel 28 is applicable to the other remaining channels 28. The channel 28 has an end wall 29 adjacent to the first surface 23 of the elongate body 22. Disposed through the first surface 23 and in communication with the end wall 29 is an aperture 31. The channel 28 extends longitudinally between the outer surface 24 and the sidewall 27 starting from the end wall 29 and exiting to the second surface 21. The portion of the channel 28 adjacent to and exiting from the second surface 21 is radiussed inwardly towards a center of the elongate body 22 so as to define a curved channel ramp 30.

The coupler 20 is provided with an actuating member 40 of a generally disc shape having an upper surface 43 and an opposed lower surface 44 bounded by an outer periphery 41. The actuating member 40 has centrally disposed therethrough an opening 42 of a second diameter D2. As shown in FIG. 5, the second diameter D2 is of a size larger than the first diameter D1 as will be further described.

Each channel 28 is provided with a respective prong member 32 having a limited resilience so as to flex through the curved channel ramp 30. Each prong member 32 has a first end 33 attached to the lower surface 44 of the actuating member 40 and extending therefrom through the aperture 31 and into the channel 28. The smaller sized opening of the aperture 31 in relation to the end wall 29 aids in guiding the first end 33 so that the prong member 32 will not buckle. The prong member 32 has at an end distal from the first end a curved portion 34. The curved portion 34 has disposed at its terminal end a barb 35 configured to penetrate the tail block 3. While the barb 35 is desirable for penetrating most materials, it may not be necessary to include the curved portion 34 with a barb 35 for penetrating harder materials. In this case the distal end of the curved portion 34 may be simply sharpened to a point.

As shown in FIGS. 2 and 5 the coupler 20 has a retracted position in which the curved portion 34 of the prong member 32 resides within the curved channel ramp 30 and the first end 33 extends above the first surface 23 so as to elevate the actuating member 40 thereabove. FIGS. 3 and 6 depict the coupler 20 in an engaged position in which the actuating member 40 has been pressed downward so as to abut the first surface 23 thereby advancing the prong member 32 downwardly into the tail block 3.

The prong member 32 may advantageously be composed of a relatively stiff wire which is configured to suitably transmit mechanical force afforded to it by the pressing of the actuating member 40. The relatively stiff wire is desirable for it is able to be manipulated to have different strength requisites. For example, the curved portion 34 can be thickened and hardened so as to be more rigid than the remainder of the prong member 32. The thickening and hardening of the curved portion 34 allows for it to maintain the curved shape even as the actuating member 40 is pressed downwardly. This permits for the curved portion 34 to make an arc as it penetrates the tail block 3 placing the barb 35 so that it is positioned generally underneath and center to the elongate body 22. This is advantageous for it allows the coupler 20 to be securely mounted to materials that are thin and would not readily accept conventional fasteners such as screws or nails.

In certain circumstances it may be desirable to provide one or more of the prong members 32 with a bias so that the curved portion 34 is always urging the barb 35 in contact with the tail block 3. Such a need may arise when the body 1 of the stringed instrument is being played harshly and vibrating excessively. In this instance the prong member 32 is provided with a protuberance 36 approximately mid-point its length. Disposed between the protuberance 36 and the end wall 29 of the channel 28 is a compression spring 37. One end of the spring 37 abuts against the end wall 29 and its opposed end abuts against the protuberance 36 so as to bias the curved portion 34 outwardly from the curved channel ramp 30 and into continuous engagement with the tail block 3.

There may be instances where it is not necessary for the curved portion 34 to be biased so as to always urge the barb 35 in contact with the tail block 3. In this case a bias may still be provided where the spring 37 is arranged as a tension spring urging the curved portion 34 to reside within the curved channel ramp 30. This is advantageous for it avoids any incidental contact with the barbs 35 until the coupler 20 is ready to be used.

In using the coupler 20, the elongate body 22 is grasped and the actuating member 40 is pulled so as to retract the curved portion 34 of the prong members 32 within the curved channel ramp 30. The second surface 21 of the elongate body 22 is then placed flush against a suitable supporting surface such as the tail block 3, as shown FIG. 5. The actuating member 40 is then pressed until the lower surface 44 contacts the first surface 23 of the elongate body 22 in which condition the prong members 32 are in the engaged position, as shown in FIG. 6.

The diameter D2 of the opening 42 is made larger than the diameter D1 of the blind bore 25 so that one may place a finger through the opening 42 and press upon the portion of the first surface 23 adjacent to the sidewall 27. This is effective in precluding any movement of the elongate body 22 as the prong members 32 penetrate a supporting surface thereby maintaining the second surface 21 flush.

The outer periphery 41 of the actuating member 40 is made so as to extend beyond the outer surface 24 of the elongate body 22. This is beneficial for it provides a surface lip for one to grasp making it easier to manipulate the actuating member 40. In removing the coupler 20 this surface lip may be conveniently grasped and pulled to place the actuating member 40 in the retracted position after which the coupler 20 may be removed. After removal the prong members 32 which had penetrated the wood and thus been removed leave only a very small prick mark that does not mar the material of the instrument body thus retaining the value and aesthetics of the stringed instrument.

Figure 4:
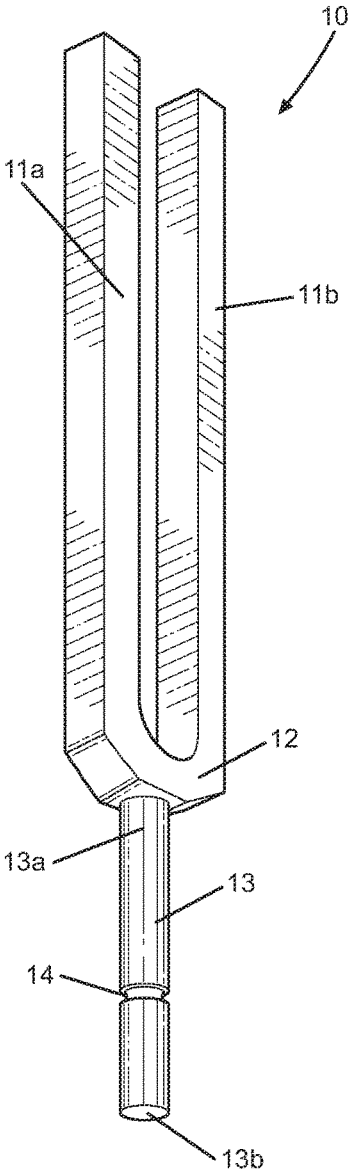
FIG. 4 is a perspective view illustrating an acoustic resonator according to an embodiment of the present invention of FIG. 1.

Referring now to FIG. 4 there is shown an exemplary acoustic resonator, such as a tuning fork 10, of the present invention. The tuning fork 10 is composed of a shaft 13 having a terminal end 13*b* and a proximal end 13*a*. Attached to the proximal end 13*a* of the shaft 13 is a base 12. Extending upwardly from the base 12 is a pair of tines 11*a*, 11*b*. It is this arrangement which permits for the resonating at a specific constant pitch when set vibrating.

Provisions are provided for releasably mounting the shaft 13 within the blind bore 25 of the elongate body 22. Such provisions preferably being that of a quick release connection. In the exemplary embodiment, the elongate body 22 is provided with one or more spring biased ball plungers 38 in communication with the blind bore 25. The shaft 13 is provided with a peripheral groove 14 that is configured so as to securely receive the spring biased ball plunger 38. As shown in FIG. 6, the shaft 13 is about to be inserted into the blind bore 25 until the terminal end 13*b* is flush with the bore wall 26. In this position the spring biased ball plunger 38 is engaged with the peripheral groove 14. This arrangement provides for a stable mounting of the tuning fork 10 to the coupler 20.

In lieu of the spring biased ball plunger 38, alternate provisions may be made to releasably retain the shaft 13 of the tuning fork 10 within the blind bore 25. For example, the sidewall 27 may be lined with a friction material, such as rubber, and the shaft 13 may be placed within the blind bore 25 and retained therein by the frictional contact. This arrangement would alleviate the need for the shaft 13 to have the peripheral groove 14. Alternately, a magnet may be secured within the blind bore 25 so as to magnetically attract and hold in place the tuning fork 10. The magnetic field generated by the magnet further aids in accelerating the vibratory sound waves through the coupler 20 and into the body 1. Other alternate types of quick release connections may be used in lieu of the spring biased ball plunger 38 as will be evident to those following the teachings of the present invention.

From the acoustic resonator being applied as shown and described, it will be apparent that as the stringed instrument is set in vibration by the fingers of the player, the sound waves will be caught and reflected by the tines 11*a*, 11*b* of the tuning fork 10 and distributed to the bottom board 2, the top sound board, and the side wall 8 of the body 1. In like return, the imparted reflected sound waves to the bottom board 2, the top sound board, and the side wall 8 are redistributed to the tuning fork 10 by virtue of its attachment to the body 1 by the coupler 20 thereby creating a feedback loop thus greatly increasing the distribution and volume of sound.

The embodiments of the invention described herein are exemplary and numerous modifications, variations and rearrangements can be readily envisioned to achieve substantially equivalent results, all of which are intended to be embraced within the spirit and scope of the invention. For example, the disclosed shape of the coupler 20 has been that of a cylindrical shape so as to facilitate the understanding of the present invention. It is to be understood that following the teachings of the present invention any one of numerous polygram shapes may be used in lieu of the cylindrical shape. Thus the elongate body 22 and the actuating member 40 may be one of rectangular, square, hexagonal, octagonal, or the like. In similar fashion the blind bore 25 and the shaft 13 may also be one of numerous complementary polygram shapes.

The Figures depict the second surface 21 as having a planar configuration so as to lie flush against a planar surface of the tail block 3. It is well within the scope of the present invention to mount the coupler 20 to a surface that is non-planar. In this instance the configuration of the second surface 21 is altered to provide a mating surface that complements the non-planar surface for a flush mounting.

It has been disclosed that the portion of the channel 28 adjacent to and exiting from the second surface 21 is radiussed inwardly towards a center of the elongate body 22 so as to define the curved channel ramp 30. However, it is well within the teachings of the present invention for the portion of the channel 28 that is adjacent to and exiting from the second surface 21 to be radiussed outwardly towards the outer surface 24 if such an arrangement would be beneficial in providing a stable mount.

In those circumstances where the surface of the supporting structure is substantive, i.e. the tail block 3 is of a large depth, the channel 28 may be linear without the use of the curvered channel ramp 30. In this instance the prong member 32 need not comprise a curved portion 34 but suffice to have the barb 35 disposed on the distal end of the longitudinally extending prong member 32.

As stated above the relatively stiff wire of the prong member 32 may be thickened and hardened to change its strength requisites. However, it is to be understood that other characteristics may be employed to achieve the desired strength requisites. For example, the wire may have a first diameter that gradually increases to a larger second diameter, or the cross section of the wire may need not be that of a circular shape but rather that of a suitable polygonal shape that varies in cross-section. As used herein the term "wire" to describe the relatively stiff wire of the present invention is not limiting to that of a wire of metal or an alloy. Rather, the wire may be of any material that can provide the desired strength requisites including that of a suitable polymer.

While the acoustic resonator has been described in accordance with a tuning fork 10 it is within the scope of the invention to use different types of acoustic resonators. All that is required is for the acoustic resonator to be of any proper shaped piece of material susceptible of musical vibrations and to have a shaft similar to the disclosed shaft 13 so as to accommodate its mounting to the coupler 20. For example, the acoustic resonator may be a cup shaped metal sound distributor, a metal spring of an inverted spiral form, or a tapered flat bar tuned to a desired pitch.

The acoustic resonator coupling has been described in the context of a single acoustic resonator. However, it is within the scope of the invention to use several couplers 20 for mounting a plurality of tuning forks 10 within the body 1 so as to obtain a desired sonic quality. For example, the use of twelve tuning forks 10 will represent an entire octave of twelve half-tones. Twelve couplers 20 would be selectively mounted within the body 1 at a desired placement such as the bottom board 2, cross bracing 4, reinforcement strip 5, or top sound board. With this arrangement of the couplers 20 it may be necessary to provide the shaft 13 of the tuning fork 10 with a right-angle bend to reorient the tines 11*a*, 11*b* such that they will reside comfortably within the body 1. Thus, the tuning forks 10 so placed will respond to each corresponding tone played forming a sympathetic vibrating system and will sound sympathetically thereby further reinforcing the volume of sound. It is understood that the number of tuning forks 10 may be increased or decreased and the pitches thereof varied so as to suit the nature of the stringed instrument.

While the coupler 20 has been described in the context of mounting an acoustic resonator to the body 1 of a stringed instrument it is well within the scope of the invention to utilize the coupler 20 for mounting various items to any suitable surface which will readily accept the prongs members 32. All that is required is for an item to have a component equivalent to the shaft 13 of the present invention. For example, a coupler 20 may be conveniently mounted to a front porch handrail and have placed therein the shaft of an American stick flag so that one may show their patriotism. The coupler 20 is especially suited to being secured to drywall permitting for the mounting of any one of numerous household items within one's home.

In those instances where it is desired to mount an item that does not have a shaft 13 it is well within the teachings of the present invention to utilize any alternate fastening arrangement. For example, in lieu of the blind bore 25 one of a strip of hook and loop fastener may be placed on the first surface 23 and the other of the hook and loop fastener may be placed on the item for fastening thereto. Alternately, one of a hook, snap fastener, magnet, adhesive or the like may be placed on the first surface 23 as a fastening arrangement.

It will be understood that certain features and subcombinations are of utility and may be employed without reference to other features and subcombinations and are contemplated within the scope of the claims. The present invention is not limited to the embodiments described above, but encompasses any and all embodiments within the scope of the following claims.

What is claimed is new and desired to be protected by Letters Patent is set forth in the appended claims:

1. A coupler for mounting an acoustic resonator within a body of a stringed instrument, said coupler comprising:

an elongate body having an outer surface, said elongate body having at an end a first surface and at an opposed end a second surface, said elongate body having at least one channel adjacent to said first surface and extending longitudinally therethrough and exiting to said second surface, said elongate body having an aperture disposed through said first surface and in communication with said channel;

an actuating member having an upper surface and an opposed lower surface bounded by an outer periphery;

at least one prong member having a first end attached to said lower surface of said actuating member and extending therefrom through said aperture and into said channel of said elongate body;

said coupler having a retracted position in which said first end of said prong member extends above said first surface of said elongate body so as to elevate said actuating member thereabove;

said coupler having an engaged position in which said actuating member is pressed so as to abut said first surface of said elongate body thereby advancing said prong member from said channel.

2. The coupler of claim 1, wherein said first surface of said elongate body comprises a releasable mounting for attaching said acoustic resonator thereto.

3. The coupler of claim 2, wherein said releasable mounting comprises a blind bore having a sidewall and terminating at a bore wall.

4. The coupler of claim 3, wherein said releasable mounting further comprises a spring biased ball plunger in communication with said blind bore.

5. The coupler of claim 3, wherein said blind bore defines an opening of a first diameter.

6. The coupler of claim 5, wherein said actuating member comprises an opening of a second diameter having a size larger than said first diameter for permitting access to and for holding said elongate body in place as said actuating member is pressed to said engaged position.

7. The coupler of claim 1, wherein said at least one channel has a portion adjacent said second surface that is radiussed so as to define a curved channel ramp.

8. The coupler of claim 7, wherein said at least one prong member is composed of a relatively stiff wire having a limited resilience so as to flex through said curved channel ramp.

9. The coupler of claim 8, wherein said at least one prong member has at an end distal from said first end a curved portion configured to reside within said curved channel ramp in said retracted position.

10. The coupler of claim 9, wherein said curved portion is more rigid than a remainder of said prong member so as to maintain its shape when said actuating member is pressed to said engaged position.

11. The coupler of claim 10, wherein said curved portion has disposed at a terminal end thereof a barb.

12. The coupler of claim 1, wherein said at least one channel defines an end wall adjacent to said first surface; said at least one prong member is provided with a protuberance approximately mid-point a length thereof; said coupler further comprises a spring having an end abutting against said end wall of said channel and an opposed end thereof abutting against said protuberance so as to bias said prong member.

13. The coupler of claim 1, further comprising:

a plurality of said at least one channel, each of said plurality of channels have an aperture in communication therewith and being disposed through said first surface of said elongate body; each of said plurality of channels further have a portion adjacent said second surface that is radiussed inwardly towards a center thereof of said elongate body so as to define a respective curved channel ramp;

a plurality of said at least one prong member, each of said plurality of prong members have a first end attached to said lower surface of said actuating member and extend therefrom through a respective said aperture and into a respective said channel; each of said plurality of prong members are configured to have a limited resilience so as to flex through a respective said curved channel ramp;

each of said prong members have at an end distal from said first end a rigid curved portion configured to reside within said curved channel ramp in said retracted position;

wherein, in the engaged position, in which said actuating member is pressed so as to abut said first surface of said elongate body, each said prong member advances its respective rigid curved portion from said curved channel ramp into an arc so as to be positioned generally underneath and center to said elongate body.

14. A body for a stringed instrument, said body including a bottom board circumscribed by a side wall and having a tail block stabilizing said side wall at a lower bout thereof, said tail block having removably mounted thereon a coupler, said coupler comprising:

an elongate body having an outer surface, said elongate body having at an end a first surface and at an opposed end a second surface, said elongate body having at least one channel adjacent to said first surface and extending longitudinally therethrough and exiting to said second surface, said elongate body having an aperture disposed through said first surface and in communication with said channel;

an actuating member having an upper surface and an opposed lower surface bounded by an outer periphery;

at least one prong member having a first end attached to said lower surface of said actuating member and extending therefrom through said aperture and into said channel of said elongate body;

said coupler having a retracted position in which said first end of said prong member extends above said first surface of said elongate body so as to elevate said actuating member thereabove;

said coupler having an engaged position in which said actuating member is pressed so as to abut said first surface of said elongate body thereby advancing said prong member from said channel so as to penetrate said tail block.

15. The body of claim 14, wherein said coupler further comprises:

a plurality of said at least one channel, each of said plurality of channels have an aperture in communication therewith and being disposed through said first surface of said elongate body; each of said plurality of channels further have a portion adjacent said second surface that is radiussed inwardly towards a center thereof of said elongate body so as to define a respective curved channel ramp;

a plurality of said at least one prong member, each of said plurality of prong members have a first end attached to said lower surface of said actuating member and extend therefrom through a respective said aperture and into a respective said channel; each of said plurality of prong members are configured to have a limited resilience so as to flex through a respective said curved channel ramp;

each of said prong members have at an end distal from said first end a rigid curved portion configured to reside within said curved channel ramp in said retracted position;

wherein, in the engaged position in which said actuating member is pressed so as to abut said first surface of said elongate body each said prong member advances its respective rigid curved portion from said curved channel ramp into an arc as it penetrates said tail block so as to be positioned generally underneath and center to said elongate body.

16. The body of claim 15, wherein said first surface of said elongate body comprises a blind bore having a side wall and terminating at a bore wall, said blind bore defining an opening of a first size; said actuating member comprises an opening of a second size larger than said first size for permitting access to and for holding said elongate body in place as said actuating member is pressed to said engaged position.

17. The body of claim 16, further comprising an acoustic resonator configured to resonate at a specific constant pitch when set vibrating by said body for a stringed instrument, said acoustic resonator comprising a shaft having a terminal end configured to be received by said blind bore such that said terminal end abuts said bore wall thereby providing for a releasable mounting.

18. The body of claim 17, wherein said coupler further comprises a spring biased ball plunger in communication with said blind bore; said shaft of said acoustic resonator comprises a peripheral groove configured so as to securely receive said spring biased ball plunger when said terminal end abuts said bore wall thereby providing said releasable mounting with a quick release connection.

19. The body of claim 15, wherein said plurality of prong members are composed of a relatively stiff wire configured to transmit mechanical force afforded to it by pressing of said actuating member.

20. The body of claim 15, wherein said rigid curved portion of said plurality of prong members have disposed at a terminal end thereof a barb.

21. The body of claim 15, wherein at least one of said plurality of prong members is provided with a protuberance approximately mid-point a length thereof; said protuberance having abutted there against a spring configured to bias said at least one of said plurality of prong members.

* * * * *